US005957146A

United States Patent [19]

Corey

[11] Patent Number: 5,957,146

[45] Date of Patent: Sep. 28, 1999

[54] MOVABLE BANISTER

[76] Inventor: Francis Eugene Corey, 1945 Mt. Shasta Dr., San Pedro, Calif. 90732

[21] Appl. No.: 09/106,972

[22] Filed: Jun. 29, 1998

[51] Int. Cl.[6] ..... A45B 1/04

[52] U.S. Cl. ..... 135/65; 135/67; 135/68; 135/69; 135/75; 52/645; 52/183

[58] Field of Search ..... 52/645, 183; 135/65, 135/67, 68, 69, 72, 75

[56] References Cited

U.S. PATENT DOCUMENTS

| | | | |
|---|---|---|---|
| 3,387,618 | 6/1968 | Swann | 135/45 |
| 3,421,529 | 1/1969 | Vestal | 135/45 |
| 4,030,255 | 6/1977 | Hartman | 52/9 |
| 4,094,331 | 6/1978 | Rozsa | 135/67 |
| 4,411,283 | 10/1983 | Lucarelli | 135/67 |
| 4,844,199 | 7/1989 | Nimz | 182/106 |
| 5,131,197 | 7/1992 | Varga | 52/183 |
| 5,282,486 | 2/1994 | Hoover | 135/69 |
| 5,499,645 | 3/1996 | Baliga | 135/67 |
| 5,787,913 | 8/1998 | Li | 135/67 |

*Primary Examiner*—Beth Aubrey
*Assistant Examiner*—Phi Dieu Tran A
*Attorney, Agent, or Firm*—Goldstein & Canino

[57] ABSTRACT

A portable banister, for use by a person in climbing or descending a staircase having a plurality of steps which are separated by risers, comprising a foot portion, a handgrip portion, and mast members extending between the foot portion and handgrip portion. The foot portion is stepped to match the contours of the staircase. In particular, the foot portion includes a pair of horizontal slabs which rest against sequential steps, and a vertical member which extends between the horizontal slabs and rests against the riser therebetween. The horizontal slabs extend parallel to each other. The distance between the horizontal slabs is adjustable to match the staircase. The mast members each extend between one of the horizontal slabs and the handgrip portion, and are each adjustable in length to vary the height and angle of the handgrip portion for the comfort and safety of the user.

2 Claims, 2 Drawing Sheets

MOVABLE BANISTER

BACKGROUND OF THE INVENTION

The invention relates to a movable banister. More particularly, the invention relates to a device which is held by a person while descending a set of stairs, the device simulates and provides the support normally provided by a banister, but is movable with the person as the stairs are descended.

As people age, they tend to have greater difficulty with mobility. Arthritis and other illnesses slowly deteriorate muscles, bones, and joints, making walking increasingly difficult. Even if walking itself does not present severe difficulty, climbing and descending stairs can make certain trips impossible to take, and certain homes impossible to live in.

In addition to the aged, other people who have suffered injuries or who are victimized by certain debilitating diseases also have severe difficulties with stairs.

Probably the most helpful device for climbing stairs is the fixed banister mounted alongside the staircase. The fixed banister provides the person with reliable, rigid support during their entire trip down the stairs. However, the banister is limited in that it only allows the person to hold on thereto with one hand. Typically, the staircase is too wide to allow the person to simultaneously use banisters on both sides of the staircase. Thus, usually the person holds the banister with one hand, and uses a secondary support device with their other hand.

The most common secondary support device is a cane. The cane is limited in that in order to provide reliable support, it must land upon sure footing every time it is lowered to the ground. In fact, typically as the cane is landing on the ground, the user is simultaneously shifting their weight toward the cane. Thus, when descending the stairs, if the cane misses a step, the user can easily fall.

U.S. Pat. No. 4,823,524 to Bednar discloses an apparatus for aiding people in walking up and down stairs. Bednar is a permanent installation mounted along the entire length of the stairs. U.S. Pat. No. 4,949,876 to Berner discloses a position adjustable handrail for use along stairways. Berner is permanently installed to a stairway and is either extended to a position where it is shoulder width apart from the fixed banister, or is retracted to a position against the wall opposite the fixed banister. Thus, Bednar and Berner are only suitable for aiding the use of one particular set of stairs where the invention is installed.

U.S. Pat. No. 5,355,904 to Wallum is a stair climbing aid which consists of a plurality of individual adjustable size blocks, which create "half-steps" for a person climbing the stairs. U.S. Pat. No. 4,844,199 to Nimz discloses a stair climbing aid, which is a movable set of steps, which divides the height of each step into several sub-steps. These devices are intended for reducing the amount of vertical height one must transgress with each step. However, these devices do not give the person the needed support while they climb or descend the stairs.

While these units may be suitable for the particular purpose employed, or for general use, they would not be as suitable for the purposes of the present invention as disclosed hereafter.

SUMMARY OF THE INVENTION

It is an object of the invention to produce a movable banister which aids a person while climbing and descending stairs. Accordingly a portable banister is provided which gives the person the same support provided by a fixed banister.

It is another object of the invention that the movable banister provides reliable sure footing to the user. Accordingly, the banister has a stepped foot portion which follows the contours of the stairs so that it can engage the stairs and provide several support surfaces, to ensure that the invention can be relied upon to provide the needed support.

It is another object of the invention that the movable banister is easily adaptable to be used on any staircase. Accordingly, the foot portion is adjustable to adapt to the rise of the stairs with which it is to be used. Additionally, mast members are adjustable to vary the height and angle of the handgrip portion.

The invention is a portable banister, for use by a person in climbing or descending a staircase having a plurality of steps which are separated by risers, comprising a foot portion, a handgrip portion, and mast members extending between the foot portion and handgrip portion. The foot portion is stepped to match the contours of the staircase. In particular, the foot portion includes a pair of horizontal slabs which rest against sequential steps, and a vertical member which extends between the horizontal slabs and rests against the riser therebetween. The horizontal slabs extend parallel to each other. The distance between the horizontal slabs is adjustable to match the staircase. The mast members each extend between one of the horizontal slabs and the handgrip portion, and are each adjustable in length to vary the height and angle of the handgrip portion for the comfort and safety of the user.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
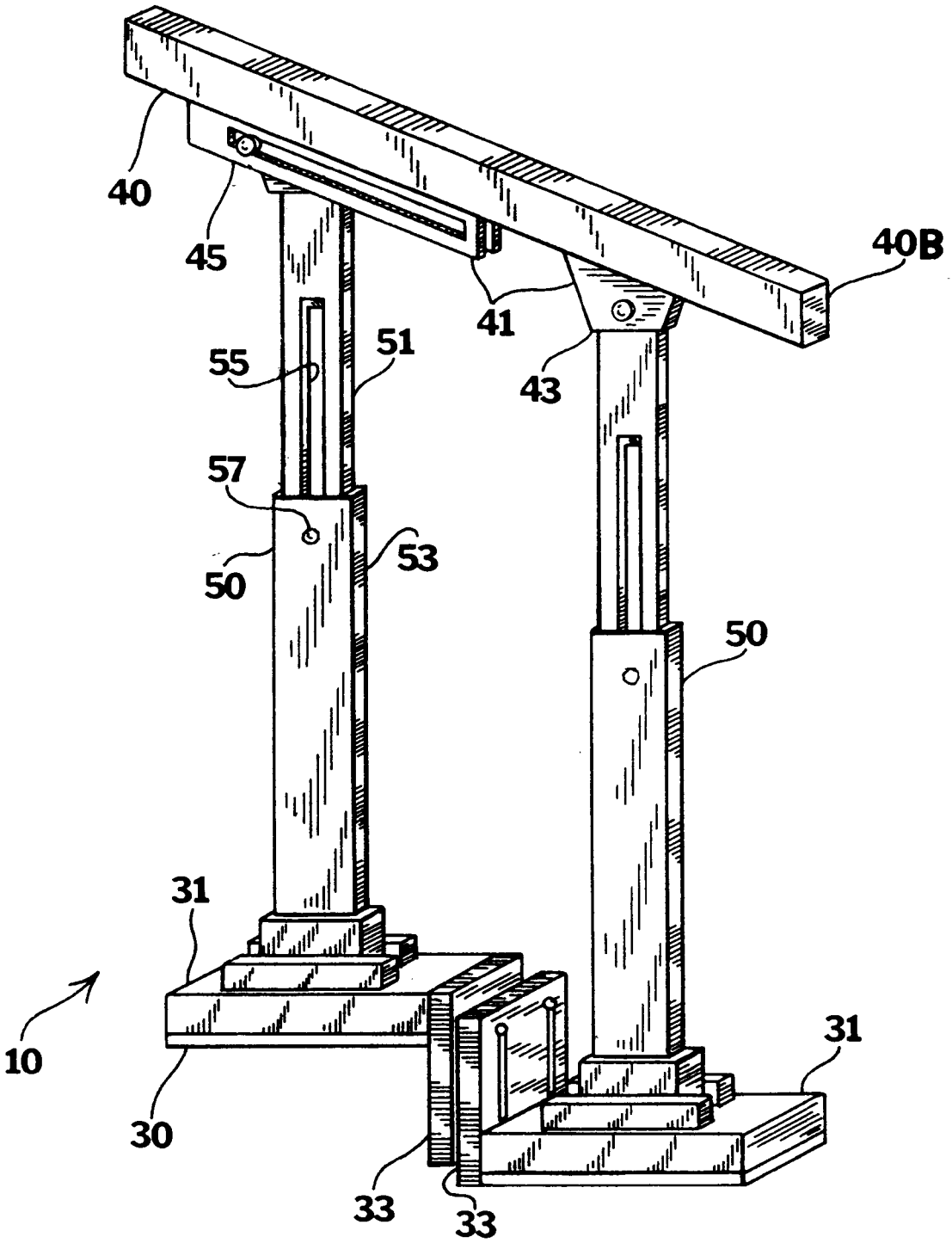
FIG. 1 is a diagrammatic perspective view, illustrating the movable banister, per se.

FIG. 1 illustrates a movable banister 10. The movable banister 10 comprises a stepped foot portion 30, a hand grip portion 40 and a pair of mast members 50 extending between the stepped foot portion 30 and the handgrip portion 40.

Important to the present invention, the stepped foot portion 30 is stepped opposite the mast members 50 and handgrip portion 40 to match contours of an actual staircase. Further, the handgrip portion 40 is angled so that the handgrip portion 40 mimics the angle of a typical banister.

The stepped foot portion 30 comprises at least one, and preferably two horizontal slabs 31. The horizontal slabs 31 extend parallel to each other, but are offset from each other. The horizontal slabs 31 are connected with at least one vertical member 33. The vertical member 33 extends between the horizontal slabs 31, such that one horizontal slab 31 rests on one step, another horizontal slab 31 rests on an adjacent, and the vertical member 33 spans the vertical distance between the steps. However, it is preferably to make the vertical member adjustable, to adjust for different rise staircases. Accordingly, two vertical members 33 are used, wherein one vertical member 33 is rigidly attached to each of the horizontal slabs 31, and the two vertical members 33 are slidably mounted to each other. Thus, the vertical members 33 are easily adjusted with respect to each other to adjust to the rise of the staircase.

The mast members 50 extend between the foot portion 30 and the hand grip portion 40. More particularly, each of the mast members 50 are rigidly attached atop one of the horizontal slabs 31, and extend vertically therefrom. The mast members 50 are each adjustable in length, to alter the distance between the foot portion 30 and the hand grip portion 40 for the comfort of the user. Accordingly, the mast members 50 include an upper mast 51 and a lower mast 53. The upper mast 51 slides within the lower mast 53. The upper mast has a slot 55, and the lower mast has a bolt 57 which extends through the slot 55, and may be tightened with a wing nut (not shown). This arrangement allows the height and angle of the handgrip portion 40 to be adjusted easily. However, many other mast length adjustment schemes, including a telescoping tube arrangement, can be employed to accomplish the goals of adjusting the height and angle of the handgrip portion, as would be appreciated by those of ordinary skill in the art.

The handgrip portion 40 is mounted to the upper mast 51 with a pair of brackets 41. The handgrip portion 40 comprises a beam 40B which mimics a typical banister. In the case of two adjustable mast members 50, a swivel bracket 43 is used for one of the brackets 41, and a slide bracket 45 is used for the other bracket. The swivel bracket 43 allows the mast member 50 attached thereto to pivot with respect thereto, and the slide bracket 45 allows the mast member 50 attached thereto to pivot and slide with respect thereto. Thus, the swivel bracket 43 and slide bracket 45 together allow adjustment of the height and angle of the handgrip portion 40 while the mast members 50 remain perfectly vertical.

Figure 2:
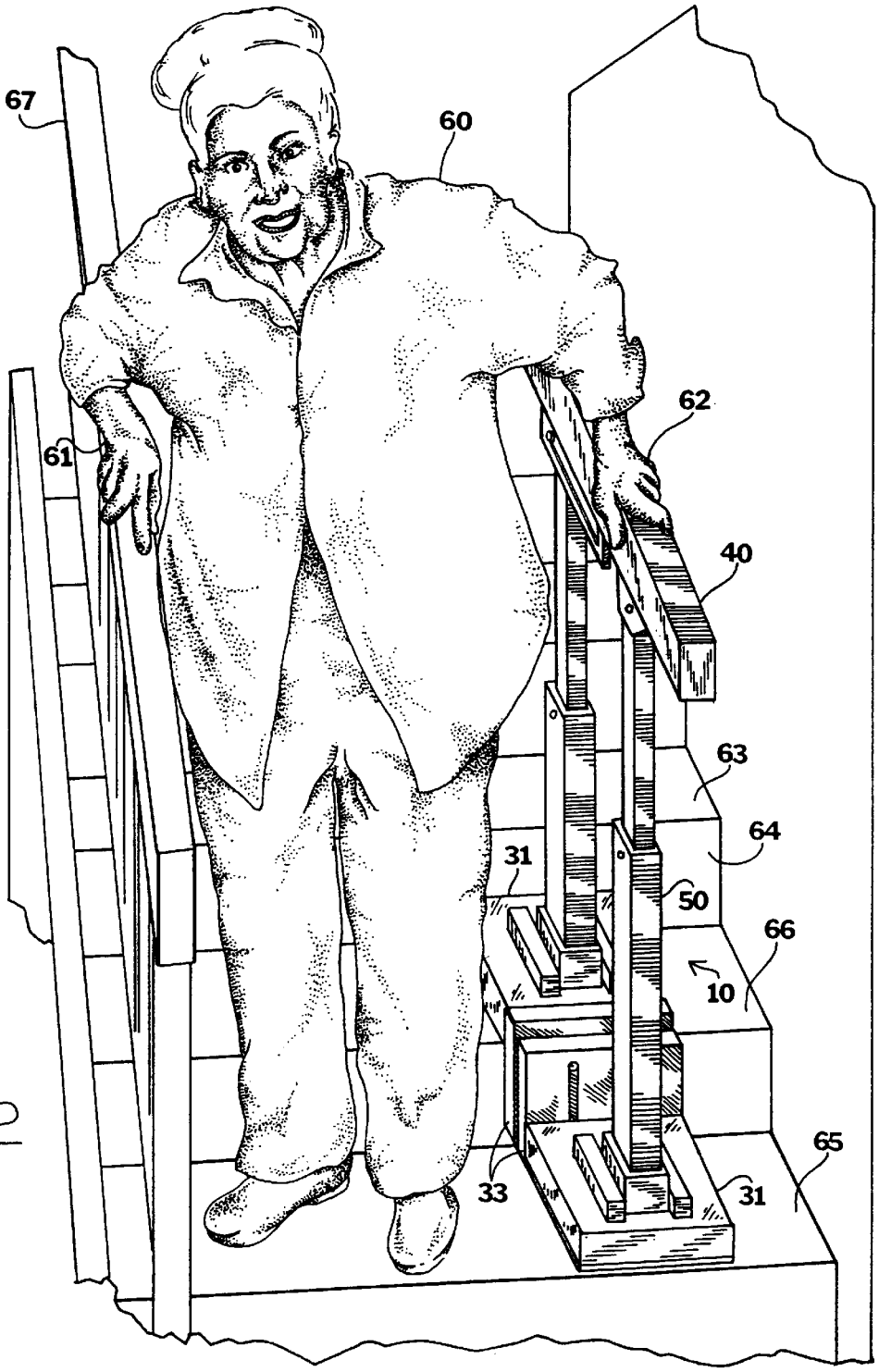
FIG. 2 is a diagrammatic perspective view, illustrating the movable banister in use, wherein a person is descending a staircase, holding the fixed banister in one hand, and the movable banister in the other hand.

FIG. 2 illustrates the portable banister 10 in use by a person 60 having a first hand 61 and a second hand 62. The portable banister 10 is being used in a staircase. The contours of the staircase are defined by a plurality of steps 63 separated by risers 64. The steps 63 including a first step 65 a second step 66. The staircase has a fixed banister 67 extending along the staircase.

The portable banister 10 is positioned on the step, wherein one of the horizontal slabs 31 is resting upon the first step 65 and another horizontal slab 31 is resting upon the second step 66. The vertical members 33 are resting against the risers 53. The person 60 is descending the staircase, holding the fixed banister 67 in the first hand 61 and the handgrip 40 of the portable banister 10 in the second hand 62. As the person descends the stairs, the portable banister 10 is lifted upward from the steps 63, and the portable banister is aligned with a lower step, lowered and rested onto said lower step. The process is repeated for each step as the staircase is descended. Prior to use, the portable banister 10 is easily adjusted to put the handgrip portion 40 in the best position for the user, by adjusting the length of the mast members 50. In addition, the vertical members 33 may be adjusted to the staircase rise, so that the horizontal slabs rest upon adjacent steps.

In conclusion, herein is presented a portable banister which allows a person to effectively climb or descend a stairway. The portable banister has a stepped lower foot which matches the contours of the staircase, and thus firmly engages against the staircase with every step, assuring reliable footing and support for the person.

What is claimed is:

1. A portable banister, for use on a staircase having a plurality of steps and risers, which separate said steps, comprising:

a foot portion stepped to match the contours of the staircase for engaging two adjacent steps and the risers between said adjacent steps, said foot portion comprising a pair of horizontal slabs which are offset from each other but extend parallel to each other, the horizontal slabs resting against the steps, and the foot portion further having a vertical member extending between the horizontal slabs which rests against the riser, said vertical member comprising a pair of vertical members which are each fixed to one of the horizontal slabs and are adjustable with respect to each other to adjust to the riser of the staircase;

a handgrip portion; and a mast, between the foot portion and the handgrip portion, comprising a pair of mast members which are each rigidly attached atop one of the horizontal slabs, and extend vertically upward therefrom to the handgrip portion, said mast members attached to said handgrip portion with brackets so that the handgrip portion is adjustable in height and in angle with respect to the foot portion, each member adjustable in length to adjust the distance between its associated horizontal slab and the handgrip portion.

2. The portable banister as recited in claim 1, wherein one of the brackets is a swivel bracket and one of the brackets is a sliding bracket.

* * * * *